United States Patent [19]

Diamond

[11] 4,171,074

[45] Oct. 16, 1979

[54] PRESSURE RESPONSIVE TILT VALVE FOR PRESSURIZED CONTAINER

[76] Inventor: George B. Diamond, R.D., Glen Gardner, N.J. 08826

[21] Appl. No.: 795,114

[22] Filed: May 9, 1977

[51] Int. Cl.[2] ..... B65D 83/14

[52] U.S. Cl. ..... 222/402.22; 251/349; 251/354

[58] Field of Search ..... 251/349, 354; 222/402.22

[56] References Cited

U.S. PATENT DOCUMENTS

| | | | |
|---|---|---|---|
| 2,615,597 | 10/1952 | Tomasek et al. | 251/354 |
| 2,704,622 | 3/1955 | Soffer | 251/349 |
| 2,829,806 | 4/1958 | Tedaldi | 251/349 |
| 2,869,764 | 1/1959 | Collins | 251/349 |
| 3,416,770 | 12/1968 | Green | 251/354 |
| 3,614,062 | 10/1971 | Kuffer et al. | 251/354 |
| 3,618,833 | 11/1971 | Webster | 251/354 |
| 3,633,798 | 1/1972 | Webster | 222/402.22 |

FOREIGN PATENT DOCUMENTS

| | | | |
|---|---|---|---|
| 634511 | 1/1962 | Canada | 251/349 |

*Primary Examiner*—William R. Cline
*Assistant Examiner*—H. Jay Spiegel
*Attorney, Agent, or Firm*—Ostrolenk, Faber, Gerb & Soffen

[57] ABSTRACT

A tiltable discharge valve for pressurized containers especially suitable for dispensing a high viscosity product, at an unexpectedly low pressure: the valve provides for increasing flow-through cross-sectional area, as the container pressure falls; the valve includes a large disc or head secured to a tiltable stem; the container pressure presses the disc into the valve seat; the valve disc tilts around its fulcruming ring to raise its sealing ring off the valve seat; the valve seat is quite yieldable and the sealing ring sinks in deeper into the seat under higher container pressure and sinks less deeply into the seat as the container pressure decreases, whereby the extent the sealing ring rises off the seat upon tilting of the stem is container pressure determined, and the amount of product delivered to the stem outlets remains generally constant even as container pressure decreases.

6 Claims, 6 Drawing Figures

PRESSURE RESPONSIVE TILT VALVE FOR PRESSURIZED CONTAINER

FIELD OF THE INVENTION

The present invention relates to a tilt type discharge valve for a pressurized container.

The valve of the invention affords a product discharge space for the product being dispensed under pressure, which space increases as the pressure within the container decreases during and following incremental discharges of the product.

BACKGROUND OF THE INVENTION

A tilt type discharge valve for a pressurized container, like that shown in my application Ser. No. 693,768, filed June 8, 1976, now abandoned, has a tiltable, hollow, central valve stem with ports arrayed around the stem and leading into the stem from the pressurized container on which the valve is mounted. The valve stem leads to the outside of the container.

A valve disc or head surrounds the valve stem inside the container. The disc seals against a stationary valve seat held on the body of the valve. With the valve disc held against the valve seat, the entrance ports to the valve stem are closed. When the valve stem and disc are tilted, an arcuate, wedge shaped passageway is made available to the pressurized product to enter the entrance ports of the stem.

On tilting of the stem and the valve head in conventional tilt valves, it is only the foremost ports of the valve stem at the side of the valve head that opens widest that receive the product generally over their full cross-sectional flow areas, whereas the other ports, and particularly the downside ports, are only partially in registry with the wedge-shaped product passageway or space above the valve head. As a result, the total flow cross-sectional area of the ports in the valve stem is not fully utilized. This presents no problem when the contents of the pressurized container are under elevated pressure, as when the container is just starting to be discharged. But, when the contents are near exhaustion and container pressure is low, the reduced flow cross-sectional area of the entrance ports inhibits adequate product flow. One of the reasons that a pressurized container must start with a high internal pressure is to secure an adequate rate of flow into the valve stem, especially when the contents of the container are approaching exhaustion.

Conventional gas pressurized containers have a constant size outlet opening. In conventional gas pressurized containers, it is, therefore, desirable that the container pressure remain substantially constant throughout the entire dispensing of all of the pressurized material, for if the pressure decreases, the flow rate of material dispensed from the container declines.

As the contents of a pressurized container are dispensed, however, the pressurizing gas in the container must fill a greater volume. Usually, this would correspondingly reduce the pressure of the pressurizing gas. This drawback is true of pressurized air. To avoid this, it has become usual to use a pressurizing medium which puts a greater quantity of pressurizing gas into the pressurized container as the volume provided for that gas enlarges. Typically, a liquefiable gas is the medium used, as a charge of such a gas will tend to maintain a continuous pressure in a container as the pressurized contents of the container are gradually expelled. For example, Freon gas is used as the pressurizing medium in many containers. Unfortunately, serious questions have been raised with respect to the environmental hazards associated with Freon gas or other such pressurizing mediums. Accordingly, it has become desirable to develop a valve for a pressurized container which enables effective use of a pressurizing medium, such as air, which is not environmentally dangerous.

BRIEF DESCRIPTION OF THE INVENTION

In a tiltable valve for a pressurized container, the valve stem projects up from the valve head inside the pressurized container, extends through the valve seat on the valve body, through the valve body and projects outside the pressurized container to the stem exit. According to the present invention, the valve head is provided with a raised fulcrum ring usually located around the periphery of the valve head. When the valve stem is tilted, the valve head fulcrums or pivots around its fulcrum ring over the valve seat. The fulcrum ring at the same time spaces the upper surface of the head to some extent from the opposed surface of the valve seat.

In addition to the fulcrum ring, the valve head may be provided with an upstanding annular sealing ring, which penetrates the valve seat. In the closed condition of the valve, the sealing ring serves to seal against exit flow of material from the container. The fulcrum ring on the valve head is preferably located at the periphery of the head while the sealing ring is nearer to the valve stem. Both the sealing ring and the fulcrum ring engage and penetrate into the yieldable valve seat in the closed condition of the valve. On tilting of the valve stem, the sealing ring remains in sealing contact with the seat throughout an initial angle of tilt whose magnitude is dependent on the pressure on the valve head.

Where separate fulcrum and sealing rings are present, the fulcrum ring may be provided with notches through which the product flows to the region external of the sealing ring in the closed condition of the valve.

The entrance ports to the valve stem are elongated above the level at which the stem is secured to the valve head and the ports extend inside the valve seat and the valve body. When the entrance ports of the valve stem are opened upon tilting of the stem, the product under pressure exits through the stem.

The valve seat, at least where it is engaged by the sealing ring and perhaps also where it is engaged by the fulcrum ring, is made of a non-rigid, yieldable, resilient material, which is locally compressible by the valve head which fulcrums thereon. For example, the valve seat may be comprised of an elastomer or compressible plastic. But, it is not the usual rigid seat. The valve seat can have a Durometer as high as 90, but for most purposes, a Durometer in the range of 20 to 50 would be satisfactory.

Other techniques for making the valve seat yieldable may be alternatively used. In place of a relatively soft and yielding valve seat, there may be provided grooves, flutes or depressions in the upper surface of the valve seat which operate to render the seat more flexible and resilient. The grooves may be in the form of a plurality of concentric radial grooves in the upper surface of a flexible but not readily penetrable seat, so that on tilting of the relatively rigid valve head, the seat is flexed to a greater or lesser extent, depending on the pressure in the pressurized container. The seat can also be made of dual layers of material with a low Durometer (sponge) faced by a higher Durometer material.

The valve head, and particularly its fulcrum ring and/or its annular sealing ring, penetrate deeply into the yieldable valve seat. As the container pressure decreases, the valve head ring or rings bite less deeply into the valve seat, because the resiliency of the valve seat material forces the ring or rings out of the valve seat. For any tilt angle of the valve stem, the depth to which the valve disc bites into the valve seat, determines how far the valve disc will be raised off its seat and determines the size of the wedge-shaped passage to the stem ports. When the container is highly pressurized, the valve disc bites deeply into the valve seat, and for any degree of tilt of the valve stem, the size of the passage leading to the entrance ports of the stem is relatively smaller. But, when the container pressure decreases, the valve head has less container pressure applied on it and its rings bite less deeply into the valve seat, whereby for the same degree of tilt of the valve stem, the size of the passage leading to the entrance ports of the stem correspondingly enlarges. As a result, the extent of opening of the passage to the valve stem varies inversely to the pressure of the product. Throughout the dispensing from the container, a generally uniform flow rate of product is obtained.

One of the benefits of the invention is that the pressurizing medium that may be used in the container could simply be ambient air. Air has the characteristic that as the volume in which the pressurized air is maintained increases, the air pressure decreases. But, the valve of the invention compensates for the reduction in the pressure of the pressurizing medium, whereby air or any other environmentally unobjectionable gas pressurizing medium may be used as the pressurizing medium.

The piston in a container normally takes up about $\frac{1}{3}$ the volume of the can. In an average can, this gives a flow rate change, from full to empty, of about 1.8:1. Such a change is not readily detectable and is acceptable to the consumer. That, however, only leaves about $\frac{2}{3}$ of the volume of the container for product. It is obvious that the more product one can put into the container, the less it costs per ounce of usable space.

Using a valve with an automatic flow control and compressed air, a piston that takes up only 1/5 the volume can be employed. Such an arrangement, with a standard valve and compressed air, will typically give a flow rate change from full to empty of 4:1, unacceptable to the consumer. The automatic flow control valve, however, will compensate for this and provide a uniform dispensation of the product.

The valve of the invention is of particular utility for controlling the discharge of highly viscous materials, i.e., of a viscosity of 10,000 cps and higher, and at an initial charging pressure for the container of 6 to 40 psig. However, the invention is not limited to such products or to such container pressures. By reason of the large flow-through cross-sectional area, provided both by the enlarged valve head and the fully exposed valve stem ports, and by reason of the pressure responsiveness of the valve, on opening of the valve, a satisfactory rate of discharge is attained for even highly viscous products even at low internal pressures over the total discharge of the contents of the container.

The valve of the present invention is illustrated in the drawings as constituting the discharge valve of a low pressure container (6 to 40 psig charging pressure) for fluent high viscosity products (10,000 cps and above). But, it is to be understood that the utility of the valve is not limited for use with containers at such pressures or with products at such viscosities.

BRIEF DESCRIPTION OF THE DRAWINGS

Various forms of the invention are illustrated in the accompanying drawings wherein.

DESCRIPTION OF THE PREFERRED EMBODIMENTS

Figure 1:
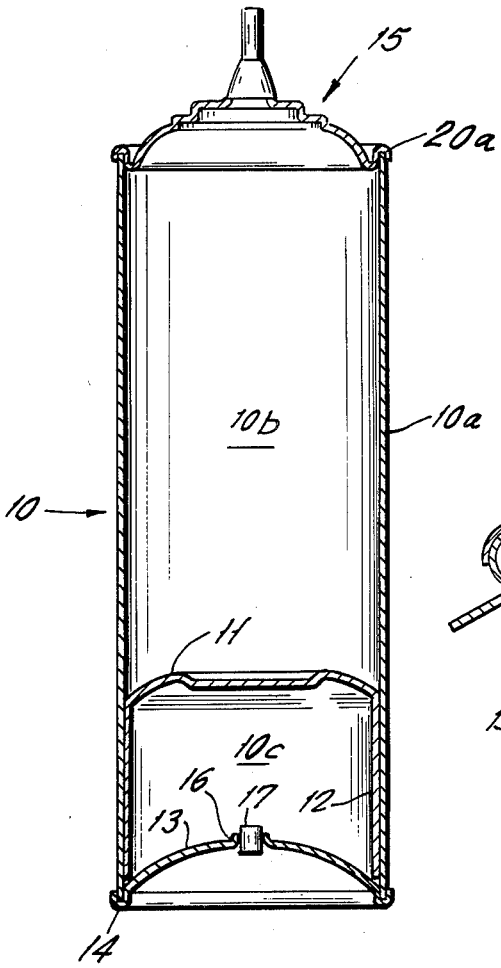
FIG. 1 is an external view of the pressurized container provided with a valve of the present invention.

Referring to FIG. 1, the pressurized container 10 is provided with and defined by a cylindrical wall 10*a*. The container 10 may be made of aluminum, extruded thermoplastic material or even cardboard with a facing of plastic or metal foil, so long as it has the strength to contain the relatively low pressure in the container.

Container 10 houses an internal barrier in the form of a piston 11 having a depending skirt 12. The bottom 13 of the container is sealed to the wall of the container by double-seaming 14 or in any other suitable manner.

The upper hollow space 10*b* of the container is filled with the pressurized product that is to be dispensed. Such filling is accomplished through the open top of the cylinder and prior to the installation of the valve 15 or any other valve according to the invention. Then the valve is secured, as described below, at the top of the wall 10*a*. After the valve 15 has been sealed to the top of the container and with the valve in the closed condition, the space 10*c* below the piston 11 and within the skirt 12 is charged with a quantity of propellant, such as air which is at a pressure of 6 to 40 psig, through a port 16 which is thereafter closed by a plug 17 of rubber, or the like. The propellant has the characteristic that its pressure drops as the volume of space 10*c* increases. But, the invention is designed to accommodate such a pressure drop. Any propellants having the pressure drop characteristic and which are environmentally unobjectionable may be used.

The valve body includes a metallic, preferably aluminum, frame or cup 19 which can be double-seamed to the top edge of the body 10*a*, as indicated at 20, or which can be crimped to the top edge of the cylinder, as shown at 20*a* in FIG. 1.

Figure 2:
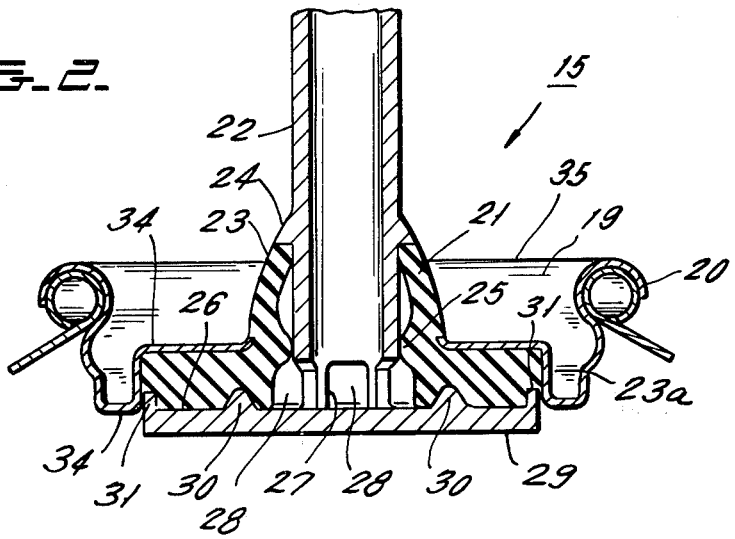
FIG. 2 is an enlarged, central, longitudinal, cross-sectional view of one form of valve of the present invention in its closed condition.

Referring to FIG. 2, the valve includes the valve body 21 of a highly yieldable, resilient rubber, elastomeric material, or the like, which is contained in the rigid metal frame 19. Valve body 21 is sealed to the hollow tube valve stem 22 through which the pressurized product is discharged upon opening of the valve. The valve body 21 includes a bowed portion 23 of annular cross-section whose upper edge abuts against the shoulder 24 formed on the stem 22, thereby providing a seal at such region and also forming one point of compression in the direction of tilt of the stem. At its bottom, the portion 23 of the valve body is turned inwardly at portion 25 to form a further seal and point of compression with the bottom portion of the stem 22. It is the resilience of the bowed portion 23 which returns the valve stem 22 to its original upright, untilted condition.

The valve body 21 has a bottom extension in the horizontal direction which forms an annular valve seat 26 on its underside. The body 21 is of a material that is sufficiently yieldable that the below described engaging portions of the valve stem sink in to a varying degree as the internal pressure in container 10 changes. As is apparent from FIG. 2, the valve body 21 is sufficiently soft for the seat 26 to be deeply depressed, at least at its annular rings of contact with the sealing ring 30 and the fulcrum ring 31 of the valve disc 29.

The bottom of the valve stem 22 is in the form of spaced posts 27, which define passageways or entrance ports 28 between them and these ports lead into the hollow interior of the valve stem. The bottom ends of the posts 27 are rigidly secured to a rigid material, circular valve disc or head 29.

On the top surface of the valve disc 29 are defined the annular fulcrum ring 31 and the annular sealing rib or ring 30 which is radially intermediate the valve stem 22 and the fulcrum ring 31. Although the heights of the rings 30, 31 are shown as being the same, they could be different, with the sealing ring 30 having a greater height than the fulcrum ring to assuredly sealingly engage the valve seat.

The degree to which the rings 30 and 31 depress the valve seat 26 is dependent upon the internal pressure in the container 10. As the internal pressure declines, the resilience of the material of the valve body 21 causes it to seek to restore itself to its original shape and in doing so, it pushes the valve disc out of the valve seat 26.

Figure 3:
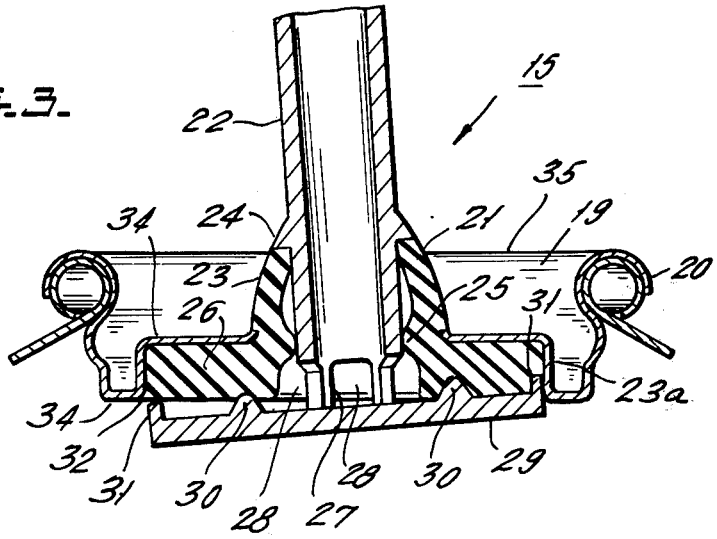
FIG. 3 shows the valve of FIG. 2 in the open condition under higher container pressure.
Figure 4:
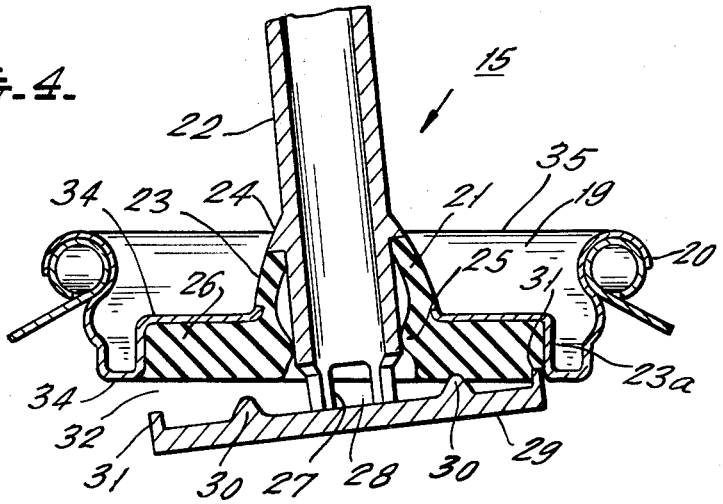
FIG. 4 shows the same valve in the open condition under lower container pressure.

FIGS. 3 and 4 illustrate the tilt operation of the valve 15 under different container pressures. In FIG. 3, the container pressure is at the higher end of its range. When the valve stem 22 is tilted in any direction around fulcrum ring 31, the valve head 29 is lifted off the valve seat 26. But, during the course of this lifting, the container pressure urges the valve disc quite hard against the valve seat. Therefore, it is not until the valve stem 22 has tilted through a relatively larger angle of tilt that the passageway 32 leading to the valve stem port 28 first develops. A substantial portion of the tilt of the valve stem 22 is absorbed in the sponginess of the valve seat 26 without any passageway opening to the ports 28. When the wedge shaped passageway 32 to the stem ports 28 finally does develop, the opening is relatively narrow, whereby under the higher pressure in the container 10, a smaller volume of material is permitted to exit, whereby the flow rate of pressurized material is properly controlled.

Turning to FIG. 4, as the container pressure decreases, due to reduction of the quantity of the pressurized material in chamber 10*b* and the corresponding enlargement of the pressurized medium chamber 10*c*, there is less pressure exerted on the valve head 29 to press it into the valve seat 26. Instead of the rings 30 and 31 biting deeply into the valve seat 26, as shown in FIG. 3, they bite in much less deeply. When the valve stem 22 in FIG. 4 is tilted to the same extent as under the container pressure of FIG. 3, much less of the tilt of the valve stem is absorbed by the elastomeric valve body 21 and the passageway 32 opens much sooner than under the high pressure condition of FIG. 3. The earlier opening of the passageway 32 will cause the passageway to be larger for any angle of tilt of stem 22 than in the pressure condition of FIG. 3. This permits a greater volume of pressurized material to flow to the ports 28. Thus, the reduction in the container pressure forcing the pressurized material to the entrance ports is compensated for by the enlarged passageway permitting a greater volume of that material to pass to the ports. As a result, the flow rate through the ports 28 remains relatively constant over the full pressure range of the container.

In the embodiment of FIGS. 3 and 4, the two rings 30 and 31 are provided and the valve disc 29 pivots or fulcrums about the radially outer fulcrum ring 31. When the fulcrum is further from the stem, for any angle of tilt of the valve stem 22, the valve disc 29 moves through a greater area arcuate pathway and the size of the opening 32 changes to a greater extent for any arcuate sweep of the disc 29. The sealing ring 30, on the other hand, bites into the valve seat 26 to seal the ports 28 closed, and it is the lifting of the sealing ring 30 off the valve seat 26 which opens the ports 28. The heights of the sealing and fulcrum rings 30, 31, respectively are shown to be the same height. It is apparent, however, that the height of the sealing ring could be made greater than that of the fulcrum ring 31, to ensure a proper seal and discontinuance of the seal at the appropriate moment.

As the fulcrum ring 31 merely provides a fulcrum about which the disc 29 pivots and it need not perform a sealing function, the annular fulcrum ring 31 may be fluted, with a series of regularly spaced grooves (not shown) about its periphery. The flutes or grooves permit passage of the pressurized material past the fulcrum ring 31 without significant interference.

Figure 5:
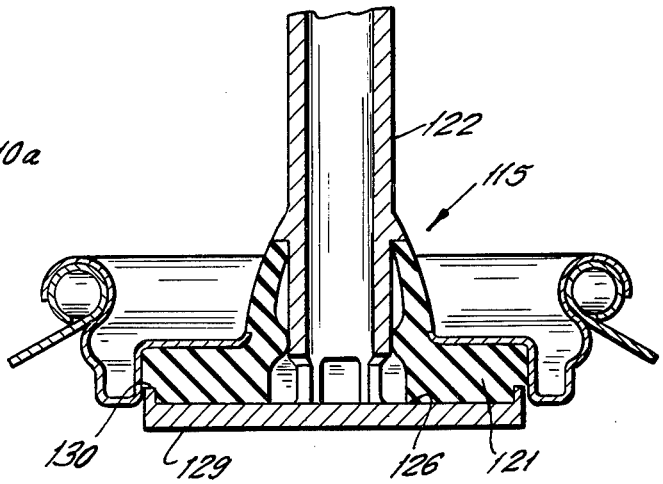
FIG. 5 shows one modified form of valve of the invention.

Referring to FIG. 5, the valve 115 is substantially the same as the valve 15 and corresponding elements are identified by corresponding reference numerals raised by 100. Previously described elements will not be described again. The principal difference between the valve 115 and the valve 15 lies in the valve head 129 and, in particular, it relates to the sealing ring 130, which in the embodiment of FIG. 5, is the only ring provided atop the valve disc 129. The sealing ring 130, therefore, also serves as the fulcrum ring around which the valve disc 129 tilts. With that exception, the valve 115 would operate in the same manner as valve 15.

Figure 6:
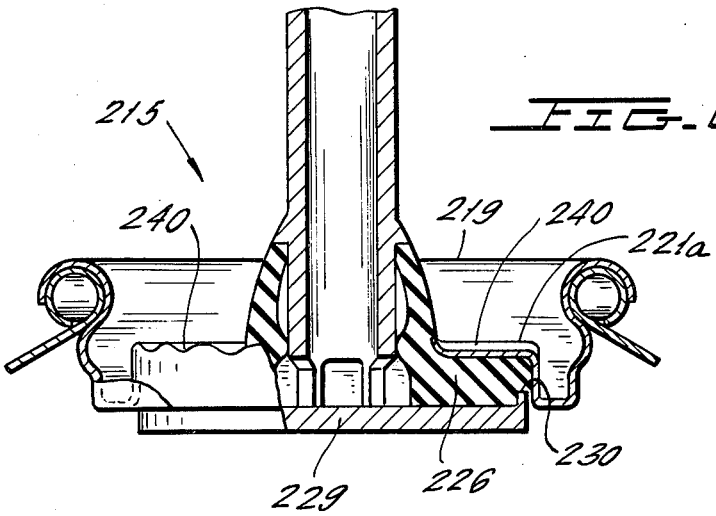
FIG. 6 shows another modified form of valve according to the invention, with the valve partially shown in cross-section.

FIG. 6 shows a valve 215, again having elements that correspond to those shown in FIG. 5 and whose corresponding elements are identified by corresponding reference numerals raised by another hundred. Thus, the valve 215 operates substantially in the same manner as the valves 15 and 115. In this embodiment, the valve seat is comprised of a material which is not soft or elastomeric. The material of the valve body 221 is still resilient and seeks to restore itself to an undeformed condition. The upper side of the valve body 221 is grooved or fluted, and is provided with a plurality of radially extending grooves 240 arrayed all the way around it. The valve body 221 is of a height to fill the chamber 221*a* provided for it. The flutes or grooves 240, on the other hand, are deep enough so as to weaken or soften the material of the valve body 221 that it might flex under the force exerted upon the valve seat 226 on the underside of body 221 by the sealing and fulcrum ring 230. The force exerted by the sealing ring deforms the valve seat to adjust for the varying pressures.

In all of the above described embodiments, and in others which now can be envisioned by a person skilled in the art, it is the yieldability of the valve seat which enables the cooperating valve head to bite more or less deeply into the valve seat, depending upon the pressure of the pressurized material against the valve head. The amount of pressurized material which is permitted to pass through the outlet ports of the valve stem is dependent upon the extent to which the valve head is moved away from the valve seat and is dependent upon the pressure of the pressurized material. As the size of the passage leading to the outlet ports increases, the pressure on the pressurized material correspondingly decreases, whereby a substantially constant flow rate of pressurized material out of the container is permitted.

Although preferred embodiments of this invention have been described, many variations and modifications will now be apparent to those skilled in the art. It is preferred, therefore, that the invention be limited not by the specific disclosure herein, but only by the appended claims.

What is claimed is:

1. A self regulating valve for use as the discharge valve of a pressurized container, said valve comprising:

a valve body; said valve body including a valve seat;

a hollow valve stem, having entrance ports located annularly around said stem and having an exit spaced away from said entrance ports along said stem;

a valve head at and secured to move with said valve stem and being located to one side of said entrance ports along said valve stem; said valve head bearing against said valve seat; means normally biasing said valve head against said valve seat; said stem is tiltable together with said valve head and relative to said valve seat; said entrance ports of said valve stem being at the side of said valve head to have entry of material to said valve stem entrance ports blocked by said valve head seating against said valve seat; said valve stem entrance ports being so placed as to be open to the discharge of material therethrough and into said valve stem upon said valve head tilting and lifting off said valve seat;

said valve seat and said valve head both being annular and extending around said valve stem;

an annular sealing ring on said valve head spaced from said valve stem and in engagement with said valve seat for sealing flow past said sealing ring into said entrance ports of said valve stem;

said valve head including fulcrum means spaced radially further from said valve stem than said sealing ring; said fulcrum means facing in the same direction as said sealing ring with respect to said valve seat and said fulcrum means being in engagement with said valve seat; said valve stem and said valve head pivot about said fulcrum means when said valve stem is tilted, and upon such pivoting, said sealing ring is gradually raised off said valve seat starting at the side of said valve body toward which said valve stem is tilted, which gradually increases the size of the passage past said sealing ring and leading to said entrance ports;

said valve seat being comprised of a deformable, deflectable material which deflects under pressure thereupon through engagement of said valve seat with said sealing ring and said fulcrum means; said valve seat being yieldable and being adapted to deform to a greater extent under the bias thereagainst of said sealing ring and said fulcrum means as the pressure is higher in the container with which said valve is associated and said valve seat being adapted to deform to a progressively smaller extent under the bias thereagainst of said sealing ring and said fulcrum means as the pressure in the container decreases, whereby for a given amount of tilt of said valve head, the circumferential length of the section of said sealing ring that has raised off said valve seat and thus the size of the passage leading to said entrance ports is dependent upon the pressure in the container, and the change in size of the passage to said entrance ports maintains the rate of flow through said valve stem as container pressure changes.

2. The self regulating valve of claim 1, wherein said valve stem extends through said valve body and said valve seat, and wherein said entrance ports of said valve stem are at one side of said valve body and said exit of said valve stem is at the opposite side of said valve body.

3. The self regulating valve of claim 1, wherein at least the portion of said valve seat on which said sealing ring bears is comprised of a yieldable material having a Durometer in the range of 20–50.

4. The self regulating valve of claim 1, wherein at least the portion of said valve seat on which said sealing ring bears is comprised of a yieldable material having a Durometer in the range of 20–90.

5. The self regulating valve of claim 1, wherein said fulcrum means comprises an annular fulcrum ring located radially outwardly of said sealing ring and extending around said stem.

6. In combination, the self regulating valve of claim 1 and a container under pressure; said valve sealing said container; said exit of said valve stem being outside said container; said valve head and said valve seat being inside said container.

* * * * *